United States Patent [19]

Harris

[11] Patent Number: 5,020,167

[45] Date of Patent: Jun. 4, 1991

[54] FLUSH TANK WATER SAVER

[76] Inventor: John L. Harris, 470 Palm Island NE., Clearwater, Fla. 34630

[21] Appl. No.: 414,664

[22] Filed: Sep. 29, 1989

[51] Int. Cl.[5] ..... E03D 1/14

[52] U.S. Cl. ..... 4/325; 4/415

[58] Field of Search ..... 4/324, 325, 415

[56] References Cited

U.S. PATENT DOCUMENTS

| | | | |
|---|---|---|---|
| 823,832 | 6/1906 | Wayman . | |
| 2,532,977 | 12/1950 | White . | |
| 4,017,912 | 4/1972 | Young, Jr. . | |
| 4,032,997 | 9/1975 | Phripp et al. . | |
| 4,483,024 | 11/1984 | Troeh | 4/324 |
| 4,651,359 | 3/1987 | Battle | 4/324 |
| 4,811,432 | 3/1989 | Harris | 4/325 |
| 4,825,478 | 5/1989 | Harris | 4/415 |

*Primary Examiner*—Linda J. Sholl

[57] ABSTRACT

An attachment for making existing flush tanks use less water mounts on the overflow pipe and has a valve operator for pushing the flush valve closed at an intermediate water level. The valve operator is controlled by a float which releases a latch allowing the operator to close the valve. The user may obtain a full flush by holding the flush handle down about 1½ seconds. Provision is made for allowing the user to convert from a partial flush to a full flush simply by flushing again immediately after a partial flush is terminated. This feature utilizes the additional drop in water level below the partial flush level. The invention also includes an improved latch-valve operator relationship having side by side sections allowing a compact construction to give unlimited movement of the valve operator. One form of the invention requires only two moving parts to perform all the functions mentioned above. This is accomplished by a latch construction having two types of relative movement between the parts. Inward relative movement releases and closes the valve. Lateral relative movement allows reengagement.

20 Claims, 4 Drawing Sheets

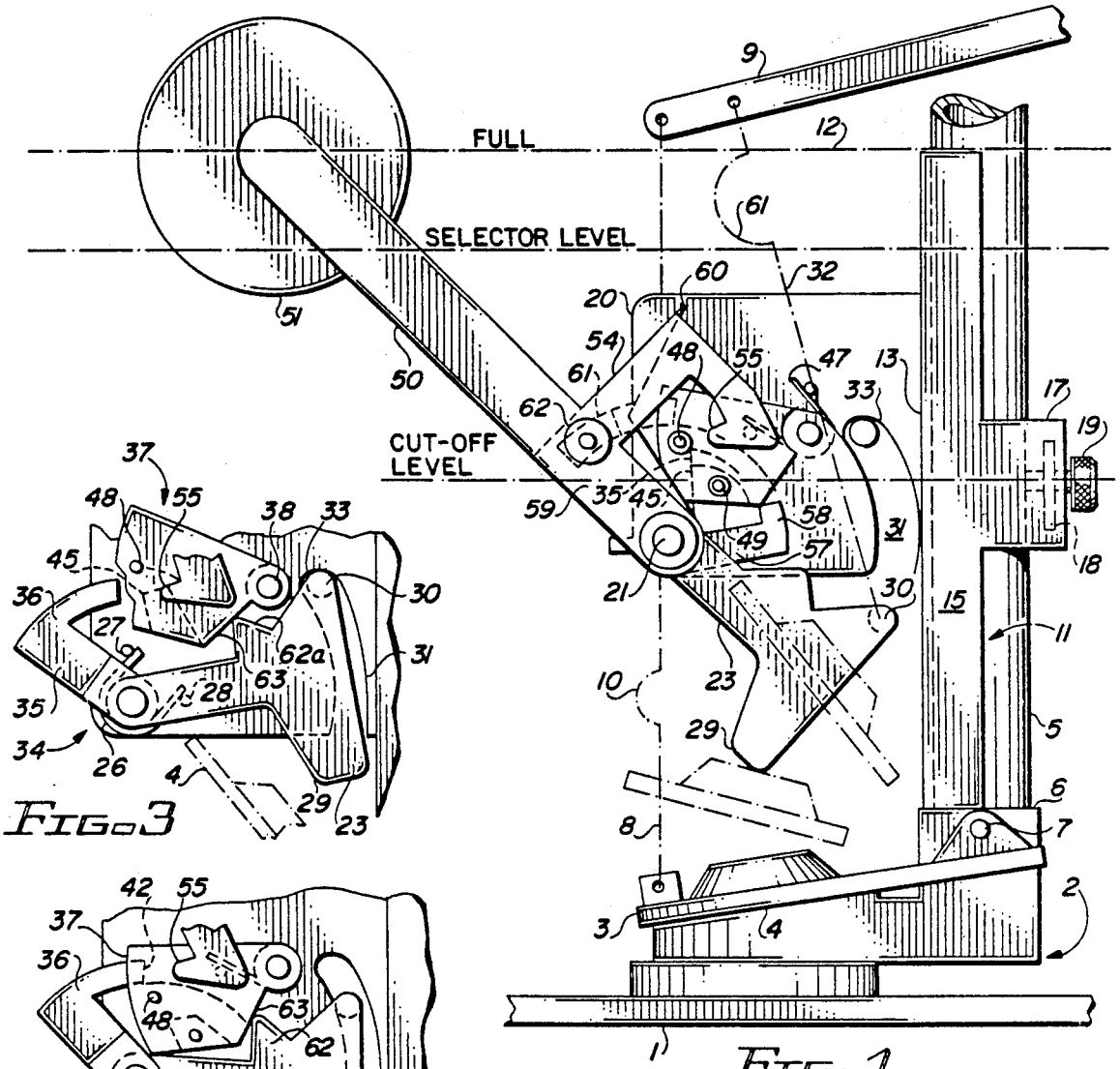
FIG. 1
FIG. 3
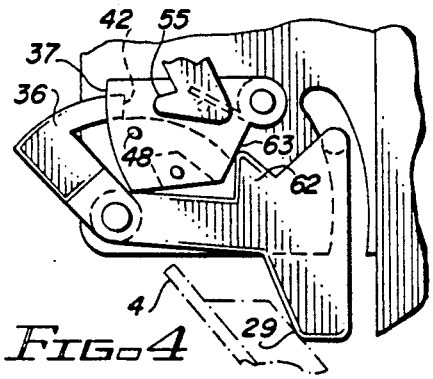
FIG. 4
FIG. 2
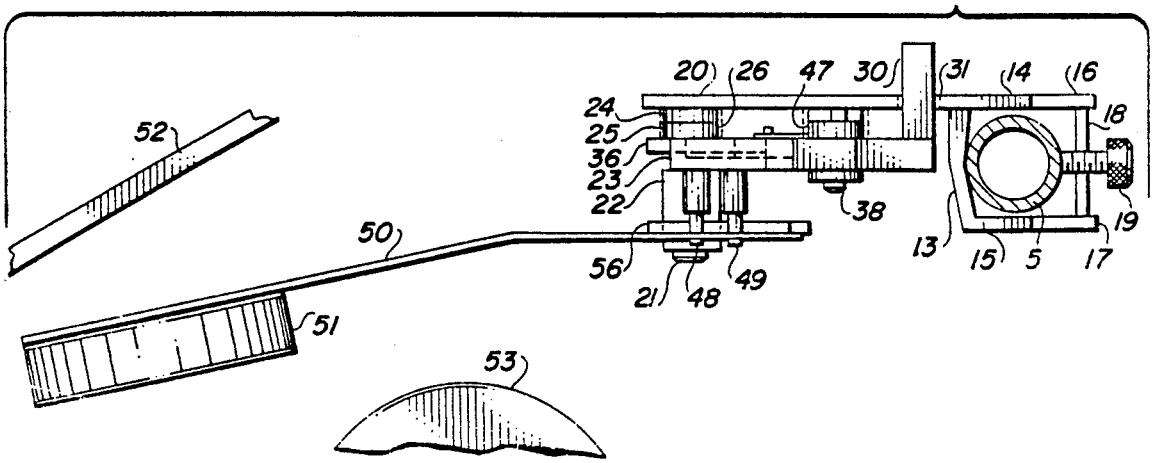

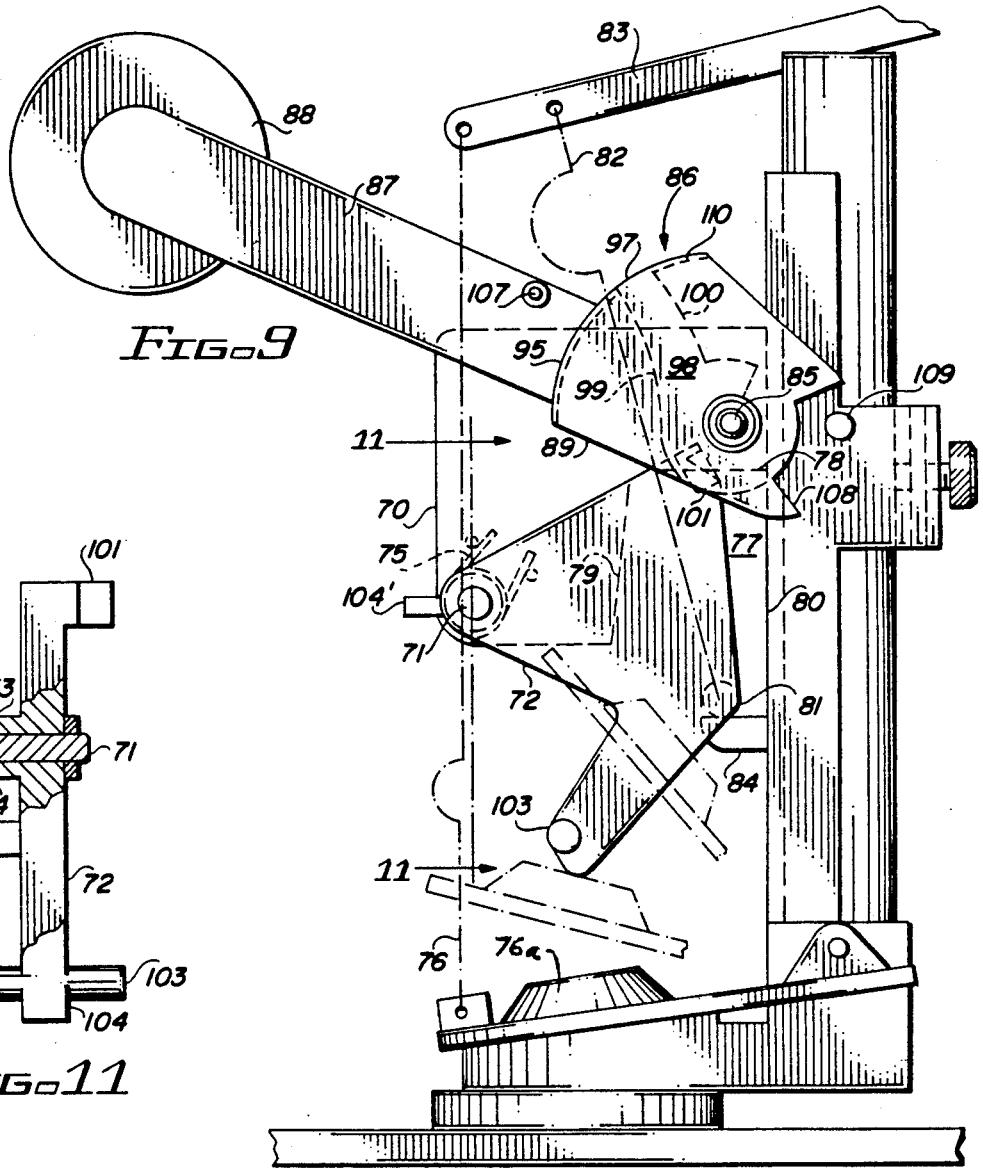
FIG. 9
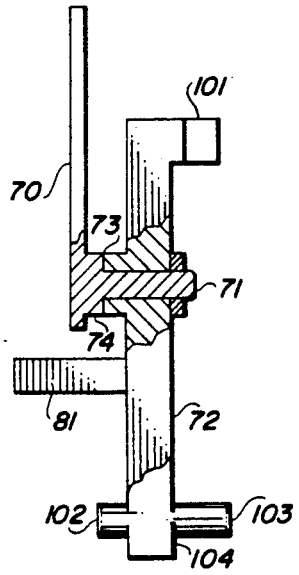
FIG. 11
FIG. 10
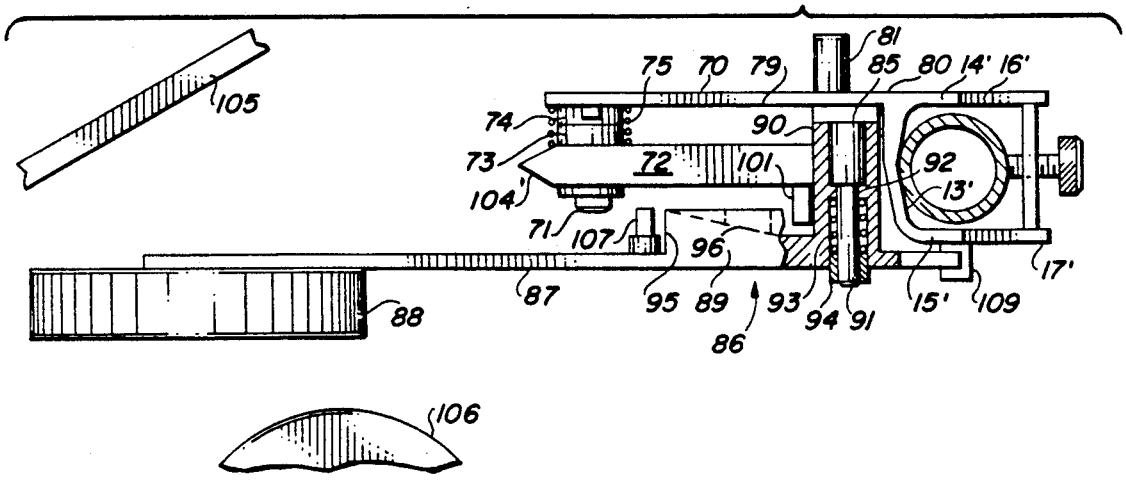

FLUSH TANK WATER SAVER

BACKGROUND OF THE INVENTION

This invention relates to water savers for standard existing flush tanks. These existing flush tanks are flagrant water wasters, using twice the water required for most flushes.

The present invention uses principles of operation disclosed and claimed in my application Ser. No. 07,030,080 filed Mar. 26, 1987, U.S. Pat. No. 4,811,432 issued Mar. 14, 1989, and application Ser. No. 07/293454 filed Jan. 4, 1989, now U.S. Pat. No. 4,941,214.

These prior inventions of mine all included water savers easily installed in existing flush tanks without changes. These water savers allowed the user to select between a water saving flush or a full flush, simply by operation of the flush handle. Ordinary operation of pushing the flush handle and releasing it gives a water saving flush. Holding the flush handle down a couple of seconds gives a full flush.

It has been found with my prior inventions that there are times when the user wants a full flush but doesn't hold the handle down long enough, getting a water saving flush. When this happens the user, to get a full flush, must push the handle down and hold it there until the tank is empty.

The present invention allows the user to convert a short flush into a full flush simply by pushing the handle down again and releasing it.

BRIEF DESCRIPTION OF THE INVENTION

Two species of the invention are disclosed. The first is FIGS. 1-8. This operates in the same manner disclosed in my application Ser. No. 07/293,454. However, the float lever extends in the opposite direction from its pivot into the space between the front of the tank and the inlet valve float. A valve operator is mounted on the same pivot as the float lever and is controlled by a latch mounted on a spaced pivot. The valve member and latch have portions extending toward each other side by side giving an increased stroke of the operator with no increase in size of the parts. After the latch releases the valve operator for a short flush, a second operation of the flush lever pulls the valve operator away from the latch and reopens the outlet valve. The resulting drop in water level rotates the latch bringing a second supporting surface under the valve operator, keeping it inactive. This converts a short flush into a full flush.

The second species (FIGS. 9-15) accomplishes all of the results of the first species with but two low cost moulded moving parts. These are a combination float lever and latch and a valve operator.

At the start of a flush, the flush handle opens the tank outlet valve and also pulls a latching projection on the valve operator from unlatched position to a point beyond latched position where it can stop the float lever. If it is held there for about 1½ seconds, the float lever engages it and the two parts lock together, stopping the float and preventing the valve operator from closing the valve. A full flush results.

If a short flush is desired, the user releases the flush handle just as soon as it stops. The projection on the valve operator drops to engage the latch and get out of the path of the float lever. The latch is elongated and moves with the float. As the water saver cut off point is reached, the end of the latch rides out from under the projection and allows the valve operator to close the valve. There is nothing in the path of the valve operator projection, allowing a long stroke of the operator. This insures valve closure in any flush tank.

The "down" side of the latch is formed with a sideways camming surface which provides for movement of the valve operator back to starting position in any position of the float lever latch.

If the user wants a full flush but doesn't hold the flush lever down long enough, the flush can be continued just by pushing the flush lever down again. The drop in water level after the cut-off brings another latching surface under the valve operator. The flush will continue until the tank is empty without holding the lever down.

The above-described constructions achieve applicant's objects which are:

To provide a low cost, simple and positive acting water saver which can be installed easily in any flush tank.

To provide a water saver having a long stroke of the valve operator to insure it will work in any flush tank.

To provide for easy conversion of a short flush to a full flush.

BRIEF DESCRIPTION OF THE DRAWINGS

FIG. 1 is a side elevation of one form of water saver installed in a flush tank with the parts in "standby" position.

FIG. 2 is a top view of FIG. 1.

FIG. 3 is a fragmentary view showing the parts at the start of a flush with the flush handle all the way down.

FIG. 4 is a fragmentary side view showing the parts after an immediate release of the flush handle for a short flush.

FIG. 9 (sheet 3) is a side elevation of the simplified water save having only two moving parts shown in "standby" position.

FIG. 10 is a top view of FIG. 9.

FIG. 11 is a side view partly in section of the valve operator taken on line 11—11 of FIG. 9.

FIG. 17 is a side view partly in section taken on line 17—17 of FIG. 19 of a modified valve operator having a retractable latch pawl.

FIG. 18 is a fragmentary top view of the valve operator and latch pawl.

FIG. 19 is a fragmentary front view.

FIG. 20 is a sectional view of the modified bearing and retainer for the float lever.

DETAILED DESCRIPTION

Embodiment of FIGS. 1-8

Figure 5:
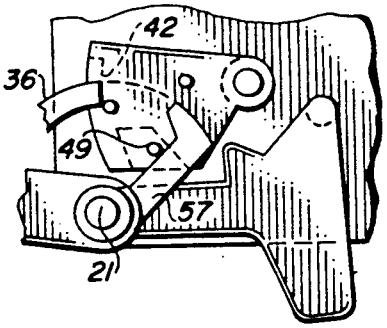
FIG. 5 (sheet 2) is a fragmentary view showing the parts at the water saving flush cut-off point.
Figure 6:
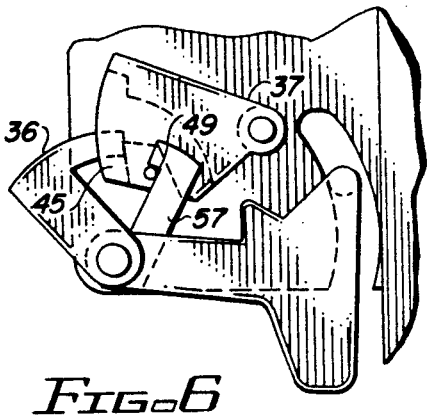
FIG. 6 is a fragmentary view showing the parts after a conversion to a full flush following a water saving cut-off.

Referring to FIG. 1, reference character 1 indicates the bottom of a standard flush tank having an outlet fitting 2 supporting the usual float type flapper valve 3 covering the outlet valve seat 4. The outlet fitting 2 also supports the usual overflow pipe 5 extending to a point above the water level, there being the usual shoulder 6 on the fitting at the juncture between the fitting and overflow pipe. The flapper valve 3 as usual is supported on pivots 7 on the outlet fitting and includes a float portion (not shown) providing buoyancy to hold the valve open until the tank is empty. This valve is pulled open at the start of a flush by a chain 8 attached to a flush lever 9 at the top of the tank. This flush lever is operated by the usual flush handle (not shown) on the outside of the tank. Pushing down on the flush handle raises lever 9, first taking up the slack 10 in chain 8 and then pulling the valve open. The valve is then held open by its buoyancy until the tank is empty. The above construction is found in most modern day flush tanks.

The water saver mechanism is carried as a unit on an elongated base 11 attached to the overflow pipe 5 and bearing against shoulder 6. This base extends from shoulder 6 to the full tank water level 12. As shown in FIG. 2, this base is generally "U" shaped, having a cross portion 13 bearing against pipe 5 and legs 14 and 15 extending beside pipe 5 to a point about the middle of the pipe. At approximately the middle of the base, legs 14 and 15 are formed with extensions 16 and 17 extending beyond the pipe 5 and supporting a clamping member 18 carrying a set screw 19. Tightening this single set screw aligns the base on the overflow pipe and holds it firmly in place regardless of the diameter of the overflow pipe.

The base is also formed with a flat integral mechanism mounting plate 20 extending to the left from the "U" shaped mounting portion. This mounting plate carries a bearing stud 21 supporting a float lever bearing 22 (FIG. 2) and a valve operator 23. The bearing stud 21 is formed with a hub 24 which matches with a hub 25 on the valve operator for spacing the operator from base portion 20 and supporting a torsion type spring 26. This spring as shown in FIG. 3 has one leg bearing against a pin 27 on the base and its other leg bearing against a pin 28 on the valve operator. This biases the valve operator to rotate in a clockwise direction.

The valve operator 23 extends to the right to a point 29 where it contacts the back of the flapper valve to push it to closed position. The valve operator 23 also carries a rearwardly extending lifting pin 30 (FIG. 2) which passes through an arcurate slot 31 in the base and is attached to a chain 32 connected to flush lever 9. The slot 31 is centered on the bearing stud 21 and the top 33 of the slot serves as a stop for pin 30 in being lifted by the flush lever.

Figure 7:
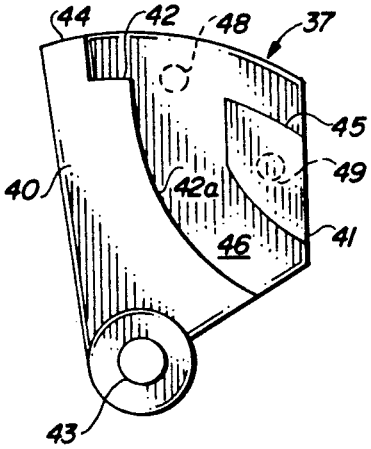
FIG. 7 is a rear view of the improved latch giving a longer valve operator stroke.

As shown best in FIG. 3, the operator 23 has a controlling section 34 consisting of an arm 35 extending upwardly to the left and merging with an arcurate narrow latch section 36 extending into contact with a latch member 37. This fits on a bearing stud 38 mounted on base member 20 and spaced from valve operator stud 21. This latch is shown enlarged in FIGS. 7 and 8. FIG. 7 is a back view of the latch shown in the other figures and FIG. 8 is a side view.

Figure 8:
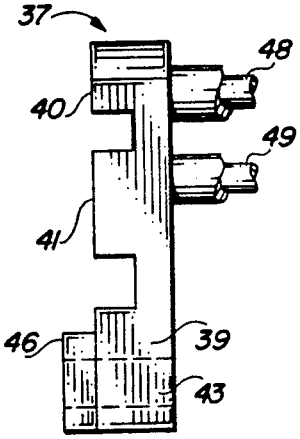
FIG. 8 is a side view of FIG. 7.

Looking at FIG. 8, the latch 37 is formed of two portions, a supporting portion 39 at the right having an outline defined by the outermost lines of FIG. 7 and controlling portions 40 and 41 at the left supported by portion 39. Portion 40 has a main latching surface 42 facing outwardly from the pivot hole 43 and a stop portion 44 which engages latch section 36 for limiting inward movement of the latch. The main latching surface terminates in a drop-off 42*a* going back to the supporting portion 39. Controlling portion 41 is formed on top with an outwardly facing holding surface 45 which holds the latch section 36 of the valve operator at times as will be explained later. It should be noted that this construction provides a channel 46 through which the narrow latch section 36 passes when the latch is released.

The latch 37 at its rear is formed with a hub 46 around hole 43 which cooperates with a hub on latch bearing stud 38 (FIG. 2) to space the latch from the base and to support a torsion spring 47. This spring biases the latch into engagement with latching section 36 of the valve operator.

The supporting section 39 of the latch also supports forwardly extending pins 48 and 49 which cooperate with the float lever as will be explained.

The float lever bearing 22 is attached to float lever 50 which extends to the left and carries a float 51 which is located between the front of the tank 52 and the usual water inlet valve float 53. Preferably this lever is made of soft noncorrosive sheet metal such as aluminum so it can be bent by the installer to place the float 51 midway between the tank front 52 and float 53.

The float lever is formed with an extension 54 (FIG. 1) which extends outwardly from the main body of the float and then downwardly to the right. The end of this extension is formed as a hook having a notch 55. This notch works with pin 48 on the latch as will be explained.

Provision is made for adjusting the water saver cut-off level so the user can "fine tune" his unit to his tank and get maximum water savings. This consists of an adjustable latch operator 56 (FIG. 2) attached to the back of the float lever. This latch operator is flat and has a large hole fitting over the float lever bearing 22 behind the float lever 50. It has two arms extending from the bearing. Arm 57 extends to the right from the bearing under pin 49 on the latch and terminates in an upwardly extending hook portion 58. Arm 59 extends from the bearing 22 to an indicator portion 60 which cooperates with extension 54 on the float lever for indicating the adjustment. Arm 59 is provided with a slot 61 through which a locking screw 62 passes for holding the parts together in adjusted position.

OPERATION OF EMBODIMENT OF FIGS. 1-8

Referring to FIG. 1, the parts are shown in the positions they assume after a partial flush and the tank has refilled, the water level being even with the top of the water saver base 11. The valve operator 23 is in down position where further down movement is stopped by contact of latch arm 35 of the valve operator with the supporting surface 45 on latch 37. In this down position, the valve operator can push the flapper valve 4 to its dotted line position shown in FIG. 1. Before it gets there the downward flow of water out of the tank has pushed the valve to its closed position shown.

To start a flush, the user operates the usual external flush handle (not shown) to raise flush handle 9. This first takes up the slack 10 in chain 8 and pulls the valve 4 off its seat. Continued upward movement of lever 9 first takes up slack 61 in chain 32 and then raises the valve operator. At the top of the stroke of lever 9 the valve operator pin 30 engages the top 33 of slot 30 as shown in FIG. 1. During this movement a projection **62*a* on the valve operator engages the surface 63 of latch 37 and rotates it clockwise to the position shown in which pin 48 is in the path of hook 55 of the float lever 50**.

Thus upward movement of flush lever 9 on starting a flush opens the flapper valve 4 and moves the valve operator 23 out of the way, allowing the valve to move to wide open position as shown in the upper dotted lines. This same movement also rotates latch 37 to the position of FIG. 3 where latch pin 48 is in the path of the hook 55 on the float lever.

If the user wishes a full flush, the lever 9 is held in its upper position for about 1½ seconds until the water level drops from "tank full" to the "selector level." During this time the hook 55 moves to the left and engages pin 48. This stops the float at this point. This position of the latch has brought the secondary holding surface 45 under latched member 36 of the valve operator. When the user releases the flush lever the valve operator latched member 36 engages surface 45 holding the operator in inactive position, causing a full flush.

When the user wants a short flush, the flush handle is pushed down to start the flush and immediately released, just as if the water saver were not there. Immediate dropping of flush lever 9 allows the parts to assume the positions of FIG. 4 in which the inner end of narrow latched section 36 engages the main latching surface 42 of latch 37. During this downward motion of the valve operator, the projection **62*a* on the operator moves away from surface 63 of the latch 37 allowing the latch to be rotated by its spring so its main latching surface 42 comes under latched section 36. In this position of latch 37 the pin 48 is out of the path of float lever hook 55 allowing the float to follow the downward moving water level. At this time, engagement of latched member 36 with main latching surface 42 holds the valve operator in inactive position allowing the flapper valve 4** to remain open.

As the float approaches the water saver cut-off level, the arm 57 of the adjustable operating arm on the float lever (FIG. 5) is rotating counter-clockwise about float lever bearing 21. It engages latch pin 49 which rotates the latch clockwise and releases arm 36 from latching surface 42. This allows biasing spring 26 to rotate the valve operator to push the valve to closed position as shown in FIG. 1, thus completing a water saving flush.

The arrangement described provides a selective means for providing either a full flush or a short flush.

If the user wants a full flush but doesn't hold the flush lever up long enough, the resulting partial flush can be converted to a full flush simply by starting another flush. At this time the flush lever 9 pulls the flapper valve open and pulls the valve operator to latched or inactive position just as if a new flush were being started. However, at this time the flush is being started at the cut-off level and the parts quickly assume the positions of FIG. 6. As the float drops below the cut-off level, the operating arm 57 continues to drive latch 37 until pin 49 engages hook 58 of the operating arm. At this position the secondary holding surface 45 on the latch is now under latched member 36 of the operator. When the flush control is released, latched member 36 engages surface 45 and holds the valve operator in inactive position allowing the tank to empty. Thus the starting of a new flush at the water saver cut-off level utilizes the additional drop in water level to provide a converting means to convert a partial flush to a full flush.

DETAILED DESCRIPTION

Embodiment of FIGS. 9-23

This embodiment of the invention requires only two movable parts mounted on a base similar to the embodiment of FIGS. 1-8 having a "U" shaped pipe mounting portion including a cross portion 13' legs 14' and 15', and extensions 16' and 17'. This base includes a flat mechanism mounting plate 70 corresponding to plate 20 of the first embodiment. This mounting plate supports a valve operator bearing stud 71 rotatably mounting a valve operator 72. This operator has a hub 73 cooperating with a hub 74 on stud 71 to space the operator from the base and support a torsion spring 75. This biases the operator in a clockwise direction for pushing flapper valve **76*a* closed as shown in FIG. 9**. The operator and spring form a valve closing means.

The base 70 is formed with an opening 77 defined by top line 78, left side line 79 and right side line 80. The valve operator 72 is formed with a rearwardly extending lifting pin 81 which passes through opening 77 in the base and is connected by a chain 82 to flush lever 83. The stroke of the valve operator is stopped at its upper position by engagement of the pin 81 with the top 78 of opening 77. This pin at the bottom of the valve operator stroke engages a projection 84 extending from the base side portion 14'.

Mounting plate 70 also supports a float lever stud 85 at its upper right corner. This stud supports a single operating control element 86 having a float lever section 87 carrying a float 88. This operating control element also includes a camming and latching section 89 having an elongated hub 90 rotatably mounted on stud 85.

The hub and stud are arranged to provide for axial or sideways movement of control element 86 in addition to rotation. As shown in FIG. 10, stud 85 has a reduced diameter portion 91 and hub 90 has a reduced internal diameter section 92 fitting over this stud portion. A compression spring 93 fits in the space between the stud and hub and is held in place by a retainer 94 which also serves as an outboard bearing for the hub. The spring 9 pushes the entire control element 86 toward base 70 against its stops and allows axial or sideways movement away from the base.

Figure 16:
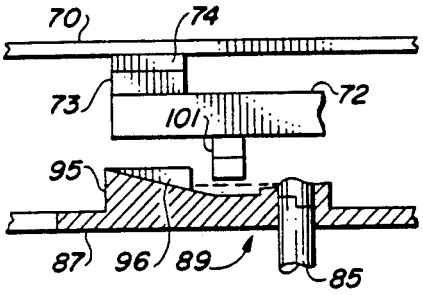
FIG. 16 is a sectional view of the sideways camming latch and valve operator.

The camming and latching segment 89 includes an outwardly facing curved latching surface 95 which preferably is a radius about the center of stud 85. This latching surface extends inwardly from the float lever section 87 as shown in FIGS. 10 and 16. The interior of the radial latching surface 95 is formed as a sideways or axial conical camming segment 96 extending from the top of surface 95 inwardly and downwardly toward stud 85 as shown in FIG. 16. The latching surface 95 is formed with a drop-off 97 coinciding with a channel 98 through the camming segment defined by radii 99 and 100.

The latching surface or member 95 controls the valve operator 72 by means of a latched member 101 extending from the valve operator 72 into engagement with the latching and camming surfaces 95 and 96. The lower end of the valve operator 72 is formed similarly to operator 23 of the first species and pushes the flapper valve from wide open position to closed position. If desired, the contact surface may be extended by pins 102 and 103 formed even with the main valve contacting surface 104 (FIG. 11). Also, if desired the operator 72 may be formed with a pointer 104' for helping the installer align the unit on the overflow pipe so the valve operator engages the middle of the flapper valve. When the unit is properly installed, the float 88 is between the front of the tank 105 and the water inlet valve float 106 as shown in FIG. 10.

Figure 12:
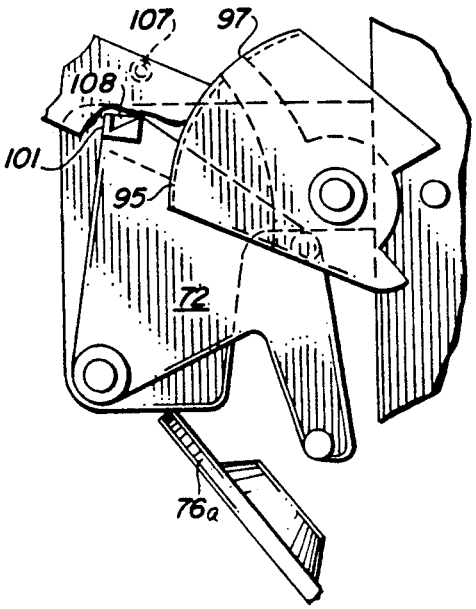
FIG. 12 (sheet 2) is a fragmentary view of the parts at starting position with the flush handle all the way down.

The float lever is provided with a stud 107 (FIGS. 9 and 10) extending toward valve operator 72 and the projection 101 on the valve operator is formed with a notch 108 (FIG. 12). These elements form a selector means for selecting between a partial flush and a full flush as will be explained.

OPERATION OF FIGS. 9–18

FIG. 9 shows the parts after a water saver flush and a full tank ready for a new flush. At the end of the previous flush the projection 101 on the valve operator 72 passed through drop-off 97 of latch surface 95, then through passage 98 in the camming segment to the position shown near but beyond control element pivot 85. During this motion the leading surfaces 102, 103 and 104 pushed the flapper valve from full open position to closed position shown. Further movement of operator 72 is stopped by engagement of lifting pin 81 with stop member 84 on the base.

When a flush is started by raising flush lever 83, the flapper valve is pulled off its seat to open position by chain 76 and the valve operator is pulled counterclockwise by chain 82 until lifting pin 81 engages the top 78 of opening 77. During this motion, projection 101 of the operator engages the conical sideways camming surface 96 and pushes the control element out of the way to permit this counter-clockwise rotation.

At this time the parts are in the positions of FIG. 12 (sheet 2). Flapper valve **76*a* is wide open. Projection 101 on the valve operator has cleared latching surface 95 and spring 93 has pushed the control element back in position where latching surface 95 can hold projection 101. Also the notch 108 in projection 101 is in the path of pin 107** on the float lever.

If the user wants a full flush, the flush lever is held up for about 1½ seconds until float lever pin 107 enters notch 108. This stops the float and also locks the operator in valve open position. A full flush results.

Figure 13:
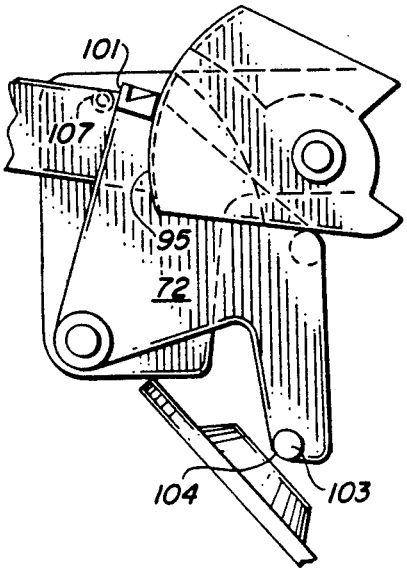
FIG. 13 is a fragmentary view of the parts when the flush handle has been immediately released for a short flush.
Figure 14:
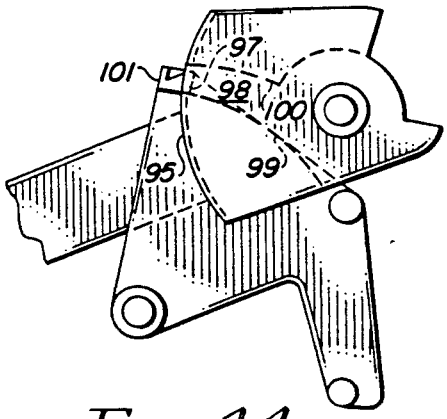
FIG. 14 (sheet 4) is a fragmentary view showing the parts at the end of a water saving flush.

If the user wants a water saver flush, the flush lever 83 is released immediately after being started. The parts now assume the positions of FIG. 13. Projection 101 has moved out of the path of float lever pin 107 and rests on the circular latching surface 95, holding the valve operator 72 in inactive position, allowing the flapper valve to remain open. As the water level drops, the elongated curved latching surface 95 slides under projection 101 until the water saver cut off point as shown in FIG. 14 is reached. Here the projection 101 enters the slot 97 of latching surface 95 and passes through channel 98 in the camming surface to the position of FIG. 9, ending the water saver flush.

If the user wants a full flush, this water saver flush can easily be converted to a full flush simply by starting a new flush at the water saver level. This reopens the flapper valve and relatches the valve operator in inactive position. Starting the new flush causes the water level to drop and the float rotates the latch to the position of FIG. 15 where stop arm 108 engages a pin 109 on the base. At this time a second supporting surface 110 on the latch has come under projection 101 and holds the valve operator in inactive position, causing the tank to empty. Supporting surface 110 constitutes a blockingmeans for preventing movement of operator 72 to valve closing position.

It should be noted that FIG. 9 shows the valve operator 72 in its down or active position where it has pushed the flapper valve closed. FIG. 13 shows operator 72 in its inactive position where it is held up by contact of projection 101 with latching surface 95, allowing the flapper valve to remain open. FIG. 12 shows the operator in flush starting position where it has been moved through and beyond active position by the flush lever and is stopped by pin 81 engaging surface 78. Here projection 101 serves to block pin 107 on the float lever to prevent a water saving flush.

In this embodiment of the invention it is important to provide clearance in slot 97 and passage 98 for the drop in water level that occurs between the time the valve operator is released and the time the valve closes. Note in FIG. 14 the passage 98 is made progressively wider to give increased clearance to projection 101 as it moves through the passage.

Figure 15:
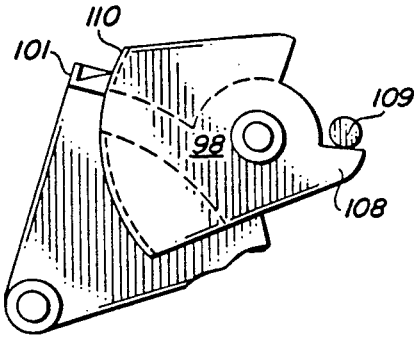
FIG. 15 shows the parts after conversion of a short flush to a full flush.

FIG. 15 shows an alternative arrangement in which the edges of the passage 98 are parallel but far enough apart to insure there will be no binding caused in the drop in water level.

FIGURES 17–19

Figure 17:
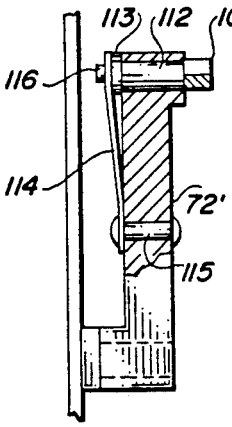
FIGS. 17, 18, 19 and 20 show a modification in which the sideways movement provided by the camming action of the latch is allowed by a retracting latch pawl carried by the valve operator.
Figure 18:
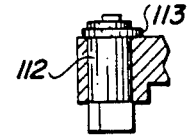
Figure 19:
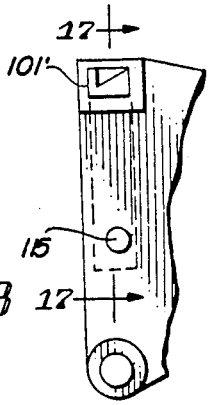
Figure 21:
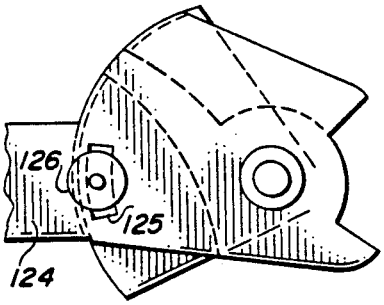
FIG. 21 is a fragmentary front view of a modified float lever and latch providing for adjustment of the water saver cut-off level.
Figure 20:
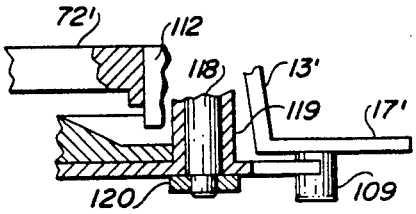
Figure 22:
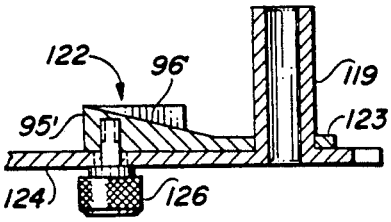
FIG. 22 is a sectional view of FIG. 21.

FIGS. 17–19 show an alternative arrangement for allowing the sideways camming movement for latching the valve operator in inactive position. Here the projection 101' on the valve operator 72' is included on a movable slide 112 which is rectangular and passes through a matching hole in the operator. The back end of the slide is formed with a stop 113 larger than the hole. A leaf spring 114 is fastened to the back of operator by rivet 115 and fits over a stud 116 formed on stop 113, pushing the slide to its forward position shown. As shown in FIG. 20, the support for the float lever hub is a plain stud 118 and the float lever bearing is a plain bearing 119 held in place by a retainer 120. There is no axial or sideways movement of the operating control element. The movable projection 101' does the yielding for the sideways camming action.

FIGURES 20–22

These figures show an adjustable model permitting the user to adjust the water saver cut-off level. Here the latching surface 95' and the camming surface 96' are formed on a separate part 122 having a hole 123 fitting over the float lever bearing 119. The float lever 124 in this embodiment is flat and is formed with a slot 125. The latch and camming part 122 has a threaded hole receiving a set screw 126 which passes through the slot. Tightening this set screw holds adjustable part 122 in adjusted position on the float lever. The flat separate float lever is formed with the stops 127 and 128 which cooperate with stud 109 on the base to limit the travel of the float lever. It should be noted that the circular latching section 95 in this embodiment is longer than latching section 95 in the fixed model to allow for adjustment. Also the distance between stops 127 and 128 is greater than in the fixed model for the same reason.

FIG. 23

In order for the flush selector means to work its best, the lifting pin 81 on the valve operator should engage top 78 of opening 77 when the flush lever 83 is held up for a full flush. This holds the notch 108 in projection 101 of the valve operator in proper position to intercept float lever pin 107 when the water level drops.

Figure 23:
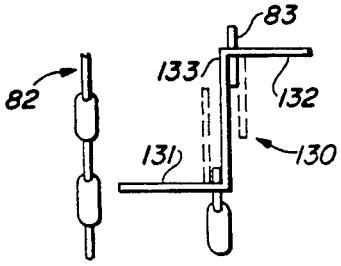
FIG. 23 is a showing of the special coupling for attaching the water saver chain to the flush lever.

It is also desirable to have available the full travel of the flush lever between its stops giving full travel to open the flapper valve. This means the best setting for attaching chain 82 to the flush lever is where lifting pin 81' engages its stop just as the flush lever engages its upper stop. FIG. 23 shows an adjusting clip 130 which simplifies best attachment. It consists of a soft noncorrosive wire form having two horizontal sections 131 and 132 connected by a vertical section 133. In installation, section 132 is first passed through a hole in flush lever 83 and bent down as shown in dotted lines. Then both chain 82 and lever 83 are pulled up as far as they go and the closest link in the chain to section 131 is passed over section 131. Section 131 is then bent up as shown in dotted lines.

I claim:

1. In a water saving device for a toilet flush tank having an outlet valve and a flush control for opening the valve on movement of the control to flush position, the combination of, first closing means for closing the valve for a full flush, second closing means including a float means for closing the valve at an intermediate level for a water saving flush, selective means controlled by the user for selecting which closing means closes the valve, said selective means being arranged to stop the float means before closure of the valve, causing a full flush, and converting means for converting a water saver flush to a full flush, said converting means including means for reopening the outlet valve and means for preventing said second closing means from reclosing the valve said preventing means including blocking means for the second closing means movable into position to stop movement of the second closing means.

2. The combination recited in claim 1 in which the preventing means when activated is activated by the float means on drop in water level below said intermediate level.

3. The combination recited in claim 1 in which the second closing means includes a valve operator movable from an inactive position to an active position for closing the valve, a latch means having a holding surface for holding the valve operator in inactive position, the float means being arranged to release the latch means at a water saving level, said latch means being part of the converting means.

4. The combination recited in claim 3 in which the converting means moves the valve operator to inactive position and in which the latch means is constructed with a second holding surface arranged to hold the valve operator in inactive position when moved there by the converting means, and means responsive to drop in water level beyond said water saving level for moving said latch means to a position making said second holding surface effective.

5. The combination recited in claim 3 in which the latch means is rotatably supported on a pivot and the latch releasing means is a float lever rotatably supported on a second pivot spaced from the first pivot, and contact means between the float lever and latch means for rotating the latch means toward releasing position as the water level drops, said contact means being located between said pivots.

6. The combination recited in claim 3 in which the latch means and water level responsive means are connected together forming a single operating control element.

7. A water saving device for a toilet flush tank having an outlet valve and a flush control for opening the valve on movement to flush position causing the water level to drop, the combination of, a valve operator pivot, a valve operator member rotatably mounted on said pivot and having an inactive position in which the valve is open and an active position in which the valve is closed, a latch pivot spaced from the valve operator pivot, a latch member rotatably mounted on the latch pivot, said members having sections extending side by side, a latching projection extending from one of said members into the path of the other providing contact means to control the valve operator member by the latch member to hold the valve operator member in inactive position when engaged, means operated by the flush control on starting a flush to move the valve operator member to inactive position and engaging the latch member which holds it there, and water level responsive means for moving the latch member to disengage the valve operator member when the water level drops to a predetermined level.

8. The combination recited in claim 7 in which the latch member has a holding surface facing away from its pivot blocking inward movement of valve operator to its active position, the part of the valve operator involved in said contact means being arranged to stay clear of the latch pivot after being released.

9. The combination recited in claim 7 in which the latch has a holding surface facing away from its pivot and the valve operator carries the latching projection contacting the holding surface, said latching projection being arranged to pass the latch pivot when the latch is released, providing a long stroke for the valve operator.

10. In a water saving device for a toilet flush tank having an outlet valve and a flush control for opening the valve on movement to flush position, lowering the water level from tank full level, the combination of closing means movable from an inactive position to an active position for closing the valve at an intermediate water level, control means for the closing means including a latching member and a latched member selectively held or released by the latching member, said latched member including means constructed and arranged to cause the closing means to remain in inactive position when held and to move to active position when released, a float mounted for movement for a substantial distance with water level between full tank level and said intermediate level, said float being attached to the latching member causing it to move in unison therewith, forming a single operating control element, said latching member having an elongated holding surface for the latched member and moving relative thereto toward releasing position as the water level drops during a flush to said intermediate level where the latched member is released.

11. The combination recited in claim 10 in which the control means includes a second holding surface on the latching member to hold the closing means in inactive position when the flush control is operated to start a flush immediately after closing the valve for a water saver flush, said second holding surface being moved into holding position by a drop in water level below said intermediate level.

12. The combination recited in claim 10 in which the control element is movably mounted for movement in one direction for releasing the latched member, said control element also being mounted for movement in a direction normal to said one direction for reengagement of the latched member with the latching member.

13. The combination recited in claim 10 in which the operating control element is rotatably mounted on a pivot and includes a float lever and a curved latching segment holding the closing means in inactive position.

14. The combination recited in claim 10 in which the operating control element is rotatably mounted on a pivot and includes a float lever and a curved latching member, the float lever being arranged to cause rotation of the curved latching member to disengage it from the latched member, and camming means between the members causing relative sideways movement therebetween providing for return movement of the members back to engaged relationship.

15. The combination recited in claim 10 in which the flush control is arranged to move the closing means to inactive position on starting a flush and in which the flush tank has a valve closing means for a full flush, selector means for selecting a full flush or a water saving flush, said selector means including blocking means mounted on the closing means and movable into the path of the operating control element when the closing means is held in its inactive position by the flush control.

16. The combination recited in claim 15 in which the blocking means moves out of the path of the operating control element and engages the latching means to hold the closing means in inactive position when the flush control is released.

17. A water saving device for a toilet flush tank having an outlet valve and a flush control for opening the valve on movement to flush position, the combination of closing means movable from an inactive position to an active position for closing the valve at an intermediate water level, a first member having a latched surface and a second member having a latching surface arranged to be engaged by the first member for holding the closing means in inactive position, water level responsive means for moving one of said members in one plane to disengage said surfaces to cause the closing means to move to its active position closing the valve, and means including camming means between said members providing relative movement of said members in a plane different from said one plane to provide return of the members back to engaged positions.

18. The combination recited in claim 17 in which the camming means is activated by the flush control on starting a flush.

19. The combination recited in claim 18 in which a surface on the first member contacts a camming surface on the second member on movement from released position back to engaged position.

20. A water saver device for a toilet flush tank having an outlet valve and a flush control for opening the valve on movement to flush position, the combination of, means for closing the valve when the tank is empty, water saver means including a float and a valve operator arranged to close the valve at an intermediate level, said valve operator being movable from an inactive position to an active position closing the valve, means operated by the flush control for moving the valve operator from active position through inactive position to a point beyond when a flush is started, and blocking means carried by the valve operator and arranged to block the float when the valve operator is at said point beyond inactive position.

* * * * *